US007912420B2

(12) United States Patent
Hajciar et al.

(10) Patent No.: US 7,912,420 B2
(45) Date of Patent: Mar. 22, 2011

(54) CHANGE-OVER SWITCH OF EXTERNAL UNITS OF FIXED AERIALS FOR SATELLITE SIGNAL RECEIVERS

(75) Inventors: Petr Hajciar, Klatovy (CZ); Michal Pokorny, Klatovy (CZ)

(73) Assignee: EMP-Centauri, s.r.o., Klatovy (CZ)

( * ) Notice: Subject to any disclaimer, the term of this patent is extended or adjusted under 35 U.S.C. 154(b) by 506 days.

(21) Appl. No.: 11/916,494

(22) PCT Filed: Jun. 2, 2006

(86) PCT No.: PCT/CZ2006/000038

§ 371 (c)(1),
(2), (4) Date: Feb. 11, 2008

(87) PCT Pub. No.: WO2006/131082

PCT Pub. Date: Dec. 14, 2006

(65) Prior Publication Data

US 2009/0025041 A1 Jan. 22, 2009

(30) Foreign Application Priority Data

Jun. 6, 2005 (CZ) ..... 2005-16699

(51) Int. Cl.
*H04H 20/74* (2008.01)

(52) U.S. Cl. ..... 455/3.02; 455/3.04; 455/428; 725/68; 725/71

(58) Field of Classification Search ..... 455/3.01–3.04, 455/303, 313, 314, 323, 193.1, 427, 428; 725/63, 68, 69, 71
See application file for complete search history.

(56) References Cited

U.S. PATENT DOCUMENTS 5,301,352 A * 4/1994 Nakagawa et al. ..... 725/71
5,670,902 A * 9/1997 Nakagawa et al. ..... 327/99
6,549,774 B1 * 4/2003 Titlebaum et al. ..... 455/427
6,957,039 B2 * 10/2005 Imai ..... 455/3.02

FOREIGN PATENT DOCUMENTS

EP 1387512 A2 2/2004

OTHER PUBLICATIONS

Kai Kriebel; "Sat-Anlagen Intelliegent Steuern: DISEQC", Jan. 1996, RFE Radio Fernsehen Elektronik, Huss Medien GmbH, Berlin, DE, pp. 45-47, XP000583401.
International Search Report: PCT/CZ2006/000038.

* cited by examiner

*Primary Examiner* — Sujatha Sharma
(74) *Attorney, Agent, or Firm* — Ladas & Parry LLP

(57) ABSTRACT

For individual reception of signals of television, radio and other services provided for by means of geostationary telecommunication satellites there is designed a change-over switch of external units of fixed aerials with a system of individual switches controlled by means of standard pulses generated by a satellite receiver. The change-over switch is provided with a command decoding unit (7), having an input (71) being connected to an output terminal (4) for connection to a satellite receiver and outputs (72) being connected to control inputs of individual switches, while the command decoding unit (7) is provided with a circuitry for a transfer of mechanical positioning equipment standard control commands to pulses controlling individual switches (2).

2 Claims, 1 Drawing Sheet

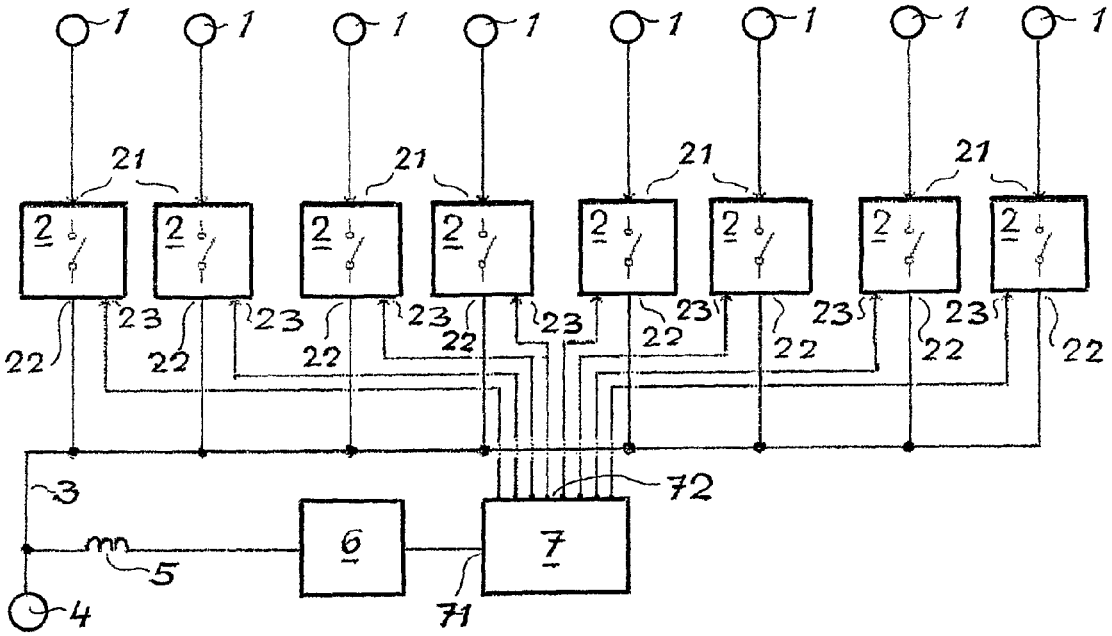
1
21
2
22
23
3
5
4
6
7
71
72

CHANGE-OVER SWITCH OF EXTERNAL UNITS OF FIXED AERIALS FOR SATELLITE SIGNAL RECEIVERS

TECHNICAL FIELD

The invention relates to a change-over switch of external units of fixed aerials for satellite signal receivers provided with a system of switches controlled by means of standard pulses generated by a satellite receiver.

BACKGROUND OF THE INVENTION

An individual reception of TV and radio programmes from geostationary satellites has extended throughout the world. Both national public service broadcasters and commercial companies offer their programmes through satellite stations. Also data services, such as a high speed connection to internet, are provided by means of satellites. A typical satellite signal receiving system consists of several basic components. Such a system comprises an aerial, an external unit, a coaxial cable and a satellite signal receiver. The external unit, located in an aerial focus, amplifies a signal and changes its frequency, the satellite signal receiver after processing the signal transfers it into a sound and/or image output. The external unit, the converter is commonly depicted as LNB element.

While many users of the system are satisfied with reception from only one orbit station, there exist an increasing number of those who request reception from two or even more satellite stations. Programmes designated for a specific group of people are very often broadcast through several satellites, like Czech spoken programmes, which are currently broadcast partly through the Astra satellite system positioned at an orbital position 19.2 degrees east, partly through a Eurobird satellite positioned at 28.5 degree east. And last but not least there exists also a large group of people interested in foreign language spoken programs. Moreover there is known a large community of so called signal hunters, known also as DX-ers.

A satellite signal reception is characterised by application of parabolic type aerials manifesting large signal gain and narrow emissive characteristic. The narrow reception signal beam prevents mutual disturbance of signals from different satellites, on the other hand a standard reception system provides for a reception of a signal from only a single satellite. The problem of a reception from several satellite positions has so far found two principal solutions. There is used either a motor-controlled reception aerial or two or more reception sets each of them having a fixed aerial. The motor-controlled reception aerial manifest a versatility as it can be oriented towards any visible position on a satellite orbit. On the other hand there is a time lag between positions and such an aerial cannot be shared by several participants. The system of fixed aerials having with converters connected to a satellite receiver through a change-over switching device offers an advantage of an immediate reception from a selected satellite and the system can be used simultaneously by more participants. The system is not so complicated and its related costs not so high as it may seem to be as a reflecting surface of one aerial can be used for several external units. On a common, so called offset parabolic aerial there may be placed up to four external units and there exist special aerials having a toroidal shaped reflecting surface where it is possible to arrange eight or even more external units. With respect to constantly decreasing costs of external units, a price of such a so called multi focus reception system comes close to that one of systems with a motor controlled aerial.

A satellite receiver provides not only for a decoding of a radio signal but also for a control of other parts of a respective receiving system, primarily for a control of an operational mode of an external unit, i.e. for a selection of incoming signal according to a polarisation and a frequency range. In a case of a reception from several satellite positions, irrespective to an applied system with a motor controlled aerial or switching of several converters, there exists a need to control a selection of a desired satellite position. In a current praxis there is more and more promoted a communication protocol commonly known as a "DiSEqC standard" created by a French company Eutelsat. This protocol integrating all desired control function into one complex digital command system has practically become an international standard. The command together with high-frequency signals are transferred by a co-axial cable interconnecting all parts of a receiving unit.

Apart from a control of the external unit operation mode, the basic version of the DiSEqC 1.0 standard enables also change-over switching between four satellite positions. Such a solution is widely used and DiSEqC relays are commonly manufactured.

If a user requests switching between five and more converters, he can use a DiSEqC 1.1 standard, which allows for a control of more extensive system. This standard e.g. makes possible an arrangement of sixteen converters into four equal groups each group being furnished with a common four-input change-over switch operating under the DiSEqC 1.0 standard. Having mechanical and cable installations completed, necessary addresses of all applied change-over switches are defined in a configuration menu of a receiver for each converter. Thus the system is ready for operation. Despite the fact the DiSEqC 1.1 standard enables to switch over even 64 inputs, it has not become widely used. This is due to rather complicated network and the fact that the DiSEqC 1.1 standard has not been considerably supported by manufacturers of satellite receivers.

For needs of motor controlled aerials there has been developed a DiSEqC 1.2 standard which provides also for commands controlling motor operation and stops, storing of aerial mechanical positions, transfer to a stored position and some other auxiliary functions. The most demanding step by installation of a system operating under the DiSEqC 1.2 standard, apart from an assembly of mechanical parts, is an identification of motor positions for individual satellites. This step is performed by consecutive rotation of the receiving system so long as a respective satellite signal appears on a monitor. The found mechanical position is stored in a rotator memory. In such a way all desired position of an aerial are defined and stored. The configuration being completed a reception of a signal from a required satellite is performed by turning the aerial to the respective stored position.

The DiSEqC 1.2 standard is widely supported and is a part of equipment of satellite receivers. Due to continuous fall of costs of converters there exists an increased interest in static multi focus installations but the obsolete DiSEqC 1.2 standard allows for only four converters to be switched over. Such a situation does not meet current demands of the market.

It is an object of the present invention to increase possibilities of reception of signals from more satellites while using a system with fixed aerials.

DISCLOSURE OF THE INVENTION

The foregoing problems are solved and the object of the invention is achieved by a change-over switch of external units of fixed aerials for satellite signal receivers provided with a system of individual switches controlled by means of standard pulses generated by a satellite receiver, constructed in accordance with the present invention, the switch comprising a command decoding unit, having an input being connected to an output terminal for connection to a satellite receiver and outputs being connected to control inputs of individual switches, while the command decoding unit is provided with a circuitry for a transfer of mechanical positioning equipment standard control commands to pulses controlling individual switches. Further in accordance with the invention the command decoding unit is connected to the output terminal for connection to a satellite receiver through an adjusting circuit.

The above design combines advantages of both above mentioned solutions of receiving signals from several satellite positions. To the contrary to a motor the change-over switch as such is a relatively simple electronic equipment presenting high reliability and long-life durability and does not require demanding and accurate mechanical processing. The switch offers a user an operation comfort of immediate switching between individual external units. Any noise caused by motor operation is completely eliminated. Basically there can be applied any command standard.

BRIEF DESCRIPTION OF THE DRAWINGS

The invention is in more details illustrated by way of an example presented in the accompanying drawing, which shows a principal block diagram of a change-over switch with eight inputs for one output.

DESCRIPTION OF A PREFERRED EMBODIMENT

Referring to the drawing there is presented a change-over switch in an 8/1 configuration, i.e. a change-over switch having eight inputs for connection up to eight satellite converters through one output to a satellite receiver. The presented change-over switch consists of eight input connectors 1 for connection of converters of eight fixed aerials. A separate electronic switch 2 is by means of its signal output 21 connected to each of the connectors 1. Signal inputs 22 of all the switches 2 merge into one common line 3 with an output connector 4 for connection to a satellite receiver. By its input 71 a command decoder 7 is through a choke 5 and an adapting circuit 6 connected to the common line 3. Command decoder outputs 72 lead to control inputs 23 of the electronic switches 2. Neither converters, nor satellite receivers are shown on the drawing as these elements are known as such and therefore are not parts of the invention.

The adapting circuit 6 may be constructed as an integral part of the command decoder 7.

A signal from each of the converters enters an electronic switch 2 through respective input connector 1. The electronic switch 2 provides for passing both high frequency signals as well as direct-current converter supply. DiSEqC commands coming from a satellite receiver are lead from the common line 3 through a choke 5 into the adapting circuit 6. The DiSEqC commands are in the adapting circuit 6 turned into voltage signals which are compatible with digital circuits and enter the command decoder 7. The command decoder 7, by means of control pulses operating individual switches 2, works with the following DiSEqC standard commands:

| No. (hex) | name | function |
|---|---|---|
| 38 | Write N0 | write to port group O (committed switches) |
| 39 | Write N1 | write to port group 1 (uncommitted switches) |
| 60 | Stop | stop positioner movement |
| 68 | Drive East | drive motor east |
| 69 | Drive West | drive motor west |
| 6A | Store nn | store satellite position |
| 6B | Goto nn | drive motor to satellite position nn |

Within the deigned change-over switch the commands "Write N0" and "Write N1" serve for a direct selection of input according the DiSEqC 1.1 standard. A value of the "Write N1" command allows for distinguishing between the first and second the second quartet of aerials. A value of the "Write N0" command allows for selection of respective aerial from the selected aerial quartet. Further commands coming from the enlarged DiSEqC 1.2 standard control a rotating device. The command "Drive East" initiates forward input rotation, the command "Drive West" initiates backward input rotation. During the rotation each consecutive input is reached with approximately two second delay to enable a user to notice a presence of required signal. The command "Stop" terminates the input rotation. The command "Store in" stores the currently selected input into an internal memory of the command decoder, where each "nn" number generated by the receiver is allocated to one of the eight inputs of the change-over switch. The command "Goto nn" selects the input of the respective switch 2, i.e. the very one which the number "nn" was allocated to by the command "Store in".

The above discussed change-over switch is thus controlled not only by the DiSEqC 1.1 standard, being the most suitable one for this purpose but also by the DiSEqC 1.2 standard. To the contrary to common change-over switches which allow for operation of only four converters, the switch according to the invention has practically no limit regarding the number of connected satellite converters. Though a theoretic maximum is 255 switched inputs, it can be expected that in praxis the number will be significantly lower, probably not higher than sixteen converters. From the point of view of a control of the change-over switch one can choose one of the two basic systems, described above.

The circuits of the command decoder 7 transfer standard commands, in the described case the commands of DiSEqC 1.1 a DiSEqC 1.2 standards into control pulses activating respective selected switch 2. By satellite receivers supporting the DiSEqC 1.1 standard it is possible to configure the receiver by allocating addresses of receiver input connectors to individual received satellites. When working with the DiSEqC 1.2 standard, the configuration is performed in analogue to positioning an aerial by a motor control, when individual switches 2 and thus the converters are successively by means of the command "Drive East" or "Drive West" switched over to each requested satellite. When a signal from the requested satellite is picked up, the number of selected switch 2 is stored by the command "Store nn". In this way there are stored numbers of switches 2 for all required satellites. The switching over between satellites is performed by corresponding command "Goto" resulting in activation of respective switch 2.

Similarly there can be used also other standards as this is only a question of applied software.

INDUSTRIAL APPLICATION

The invention is designed for individual reception of television, radio and other services provided for by means of geostationary telecommunication satellites.

The invention claimed is:

1. A change-over switch of external units of fixed aerials for satellite signal receivers provided with a system of individual switches controlled by means of standard pulses generated by a satellite receiver, characterized in, that it is provided with a command decoding unit (7), having an input (71) being connected to an output terminal (4) for connection to a satellite receiver and outputs (72) being connected to control inputs of individual switches, while the command decoding unit (7) is provided with a circuitry for a transfer of mechanical positioning equipment standard control commands to pulses controlling individual switches (2).

2. A change-over switch according to claim 1, characterized in, that the command decoding unit (7) is connected to the output terminal (4) for connection to a satellite receiver through an adjusting circuit (6).

* * * * *